United States Patent [19]

Fukatsu et al.

[11] 4,296,355

[45] Oct. 20, 1981

[54] MAGNETRON WITH COOLING MEANS

[75] Inventors: Akihiro Fukatsu; Isao Tada, both of Yokohama, Japan

[73] Assignee: Toshiba Corporation, Kawasaki, Japan

[21] Appl. No.: 93,898

[22] Filed: Nov. 13, 1979

[30] Foreign Application Priority Data

Nov. 13, 1978 [JP] Japan ..... 53-155877[U]

[51] Int. Cl.[3] ..... H01J 25/50

[52] U.S. Cl. ..... 315/39.51; 313/45; 313/46; 315/39.67; 315/39.71

[58] Field of Search ..... 315/39.51, 39.67, 39.71; 313/45, 46

[56] References Cited

U.S. PATENT DOCUMENTS

| | | | |
|---|---|---|---|
| 2,429,291 | 10/1947 | Okress | 315/39.67 X |
| 2,454,031 | 11/1948 | Bondley | 313/45 X |
| 2,591,976 | 4/1952 | Stinchfield | 315/39.51 X |
| 3,577,033 | 5/1971 | Aoki et al. | 313/45 X |
| 3,716,750 | 2/1973 | Nakada et al. | 315/39.51 |
| 3,967,154 | 6/1976 | Tashiro et al. | 315/39.51 |
| 4,048,542 | 9/1977 | Miura | 315/39.51 |
| 4,071,804 | 1/1978 | Koinuma et al. | 315/39.51 |

*Primary Examiner*—Saxfield Chatmon, Jr.

[57] ABSTRACT

A magnetron comprises an anode with an anode axis and an antenna terminal disposed along an antenna axis. The antenna axis is offset from and parallel to the anode axis. A cooling element surrounds the anode for cooling the anode. The outermost periphery of the cooling element which forms the overall shape of the magnetron has a longitudinal center axis disposed coaxially along the antenna axis to permit the adaptability of the magnetron to substantially all types of oven waveguides.

5 Claims, 6 Drawing Figures

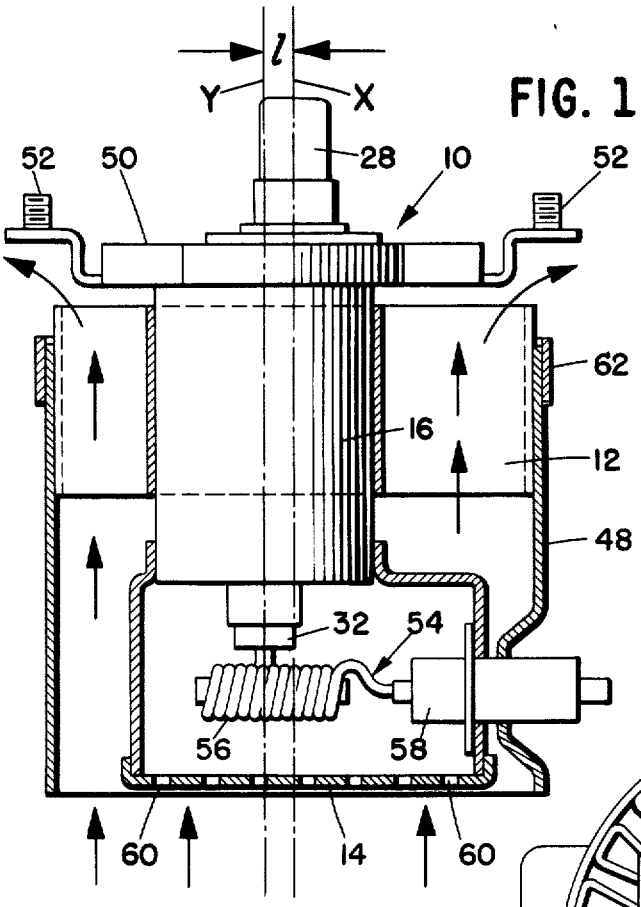
FIG. 1
FIG. 3
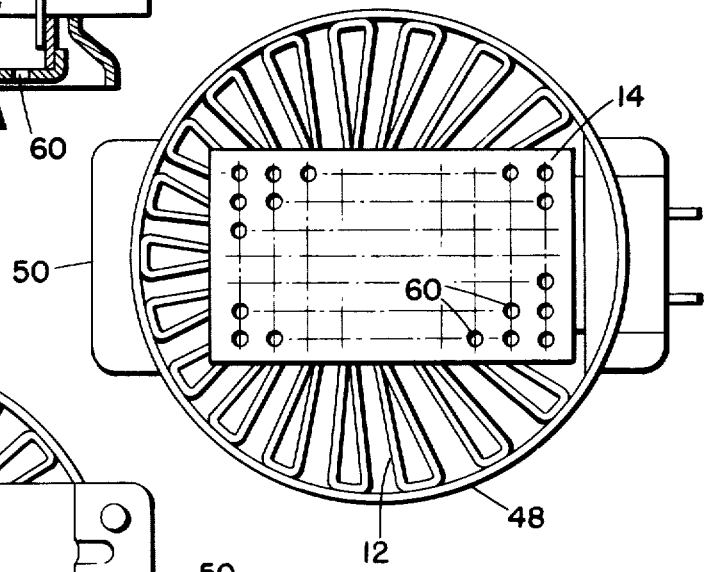
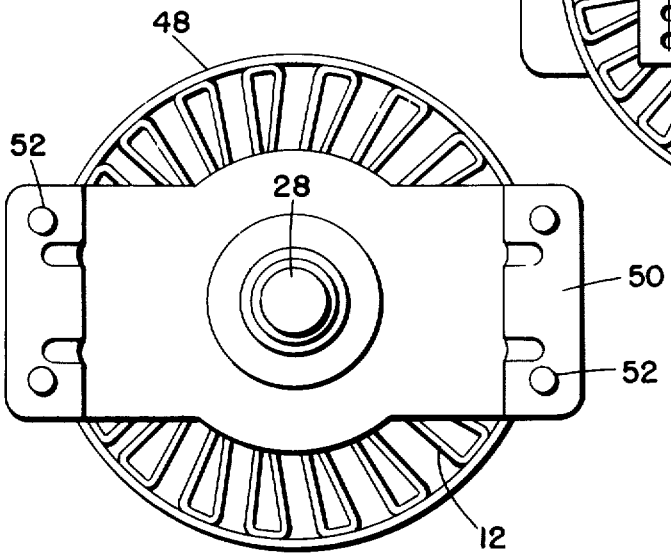
FIG. 2

FIG. 5
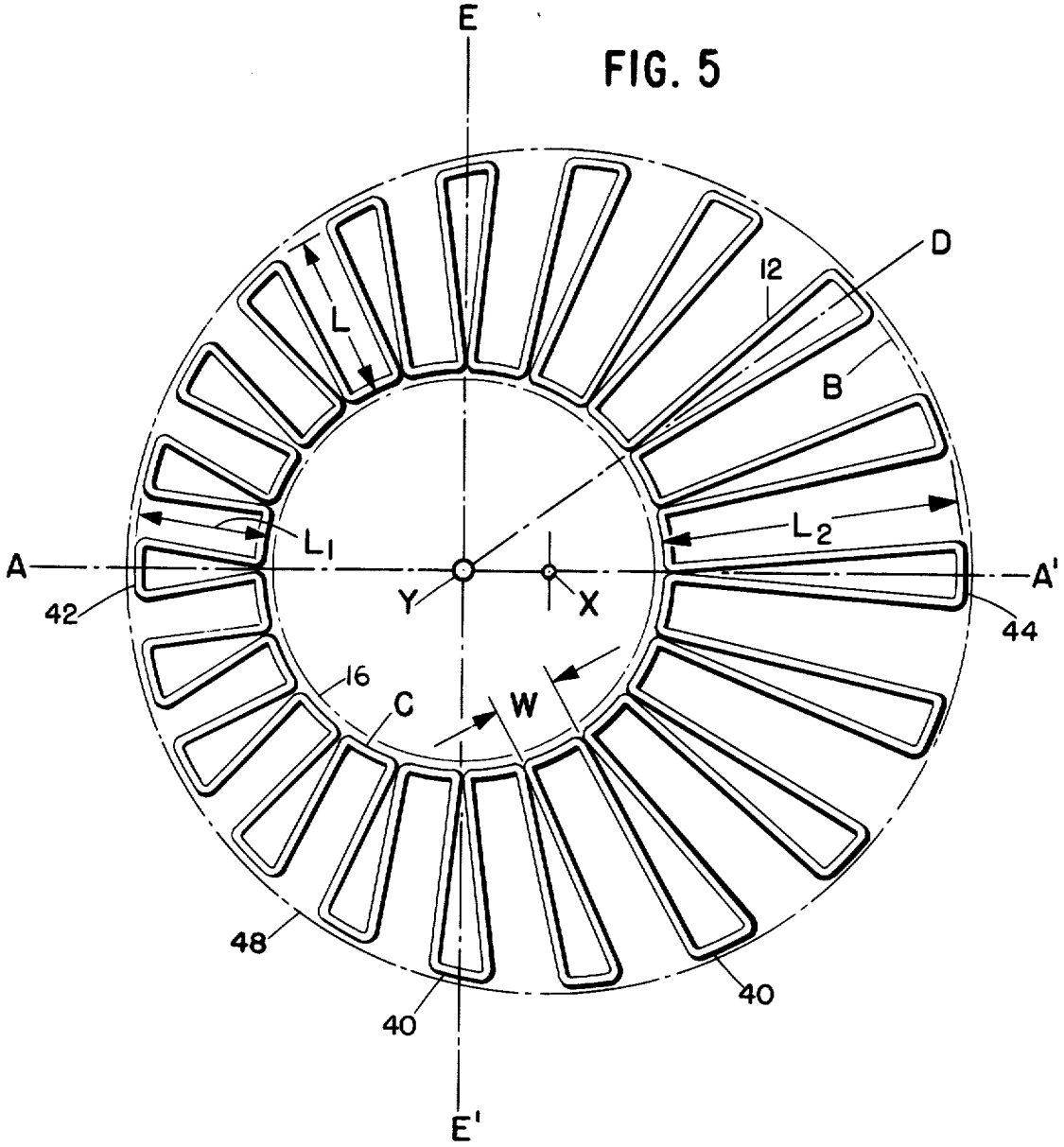
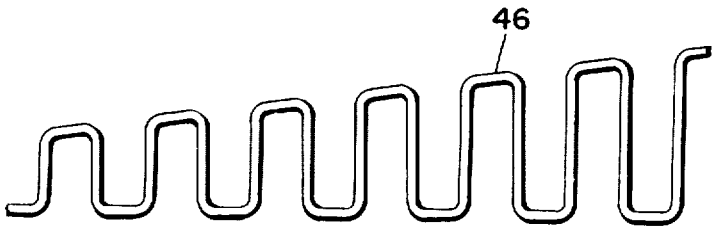
FIG. 6

MAGNETRON WITH COOLING MEANS

BACKGROUND OF THE INVENTION

This invention relates to a magnetron and more particularly to a magnetron having a longitudinal type cooling structure.

Magnetrons used in microwave ovens are generally provided with cooling fins. The cooling fins are secured around a cylindrical anode wall within the magnetron for cooling by forced air flow. The cooling fins of the prior art have either a longitudinal type structure or a lateral type structure. The lateral cooling structure comprises fins which are fitted radially around the anode wall to form air flow paths transverse to the axis of the anode. The longitudinal cooling structure comprises fins which are also fitted radially around the anode wall, however, air flow paths are created along the anode axis rather than transverse thereto. One conventional magnetron (i.e., external magnet type magnetron), utilizing either a longitudinal or lateral type cooling structure, has an antenna output portion disposed coaxially with the anode axis. The cooling fins of this coaxial structure are of equal length. Such a concentric antenna structure permits the magnetron to be adapted to almost all types of ovens. That is, the concentricity of such a magnetron upon being rotated on its antenna terminal axis to its mounting position on the waveguide within the oven facilitates accessiblity to the magnetron's input plug and alignment with the pre-positioned air flow duct within the oven.

In recent years, however, an internal magnet type magnetron has been developed; this magnetron has a smaller size and lighter weight than the previously used magnetrons. Because of its size and weight internal magnet type magnetrons are generally used. The simplest internal magnet magnetron to manufacture is the type wherein the antenna terminal is offset from the anode axis. The offset is created by the necessary positioning of a permanent magnet along the anode axis adjacent the antenna output terminal. Consequently, the antenna terminal must be positioned away from the anode axis (i.e., offset) to permit the antenna lead to reach the antenna terminal. As with all magnetrons, the internal magnet magnetron also comprises cooling fins of equal length which are fitted radially around the anode wall, wherein the periphery of these fins from the overall shape of the magnetron.

In view of the fact the antenna terminal is offset from the anode axis and the fins are of equal length, each point on the periphery of the fin does not lie at a substantially uniform distance from the antenna axis. Consequently, upon rotating the prior art internal magnet magnetron on its antenna terminal axis during mounting to the waveguide eccentricity will be experienced.

Several disadvantages result from mounting an offset antenna terminal of the internal magnet magnetron and its concomitant eccentricity to a microwave oven. First, it is necessary for the magnetron to be adaptable to substantially all types of oven waveguides. The eccentricity caused by the offset and equal length fins makes aligning the magnetron mounting bracket with the standard waveguide mounting holes of various ovens very difficult. Second, the mounting space for the magnetron within standard microwave ovens is very limited. The eccentricity caused by the offset and equal length fins produces misalignment of its coolant guiding means, surrounding the fins of the magnetron, with the pre-positioned air flow duct within the oven. Third, because of the limited space within the oven and the eccentricity experienced by these prior art magnetrons during mounting, frequent inaccessibility to the magnetron's input plug occurs.

SUMMARY OF THE INVENTION

An object of this invention is to overcome the disadvantage of the conventional offset antenna type magnetron in adapting to substantially all types of microwave ovens including difficulties in mounting, misalignment with pre-positioned oven elements and inaccessibility to input plug.

A further object of this invention is to provide an offset antenna type magnetron being interchangeable with the conventional coaxial antenna type magnetron.

Another object of this invention is to provide an offset antenna type magnetron having an antenna axis which is coaxial with the longitudinal center axis of the magnetron's overall shape.

In accordance with one aspect of this invention, an internal magnet type magnetron is provided with an anode comprising a top and bottom portion and having an anode axis. A cathode is disposed within the anode and an antenna terminal is further disposed along an antenna axis which is offset from and substantially parallel to the anode axis. For cooling the anode, a cooling element surrounds the anode comprising a plurality of fins wherein the length of successive fins gradually varies from a minimum length to a maximum length so as to have an outermost periphery wherein each point on the periphery lies at a substantially uniform radial distance from the antenna axis.

BRIEF DESCRIPTION OF THE DRAWINGS

FIG. 1 is a side elevation partially in section of one embodiment of this invention.

FIG. 2 is a top plan view of the magnetron shown in FIG. 1.

FIG. 3 is a bottom plan view of the magnetron shown in FIG. 1.

FIG. 5 is a horizontal sectional view of the cooling element of the invention taken along line 5—5 of FIG. 4.

FIG. 6 is a developed plan view of a fragment of the cooling fin of this invention.

DETAILED DESCRIPTION OF THE PREFERRED EMBODIMENT

Figure 4:
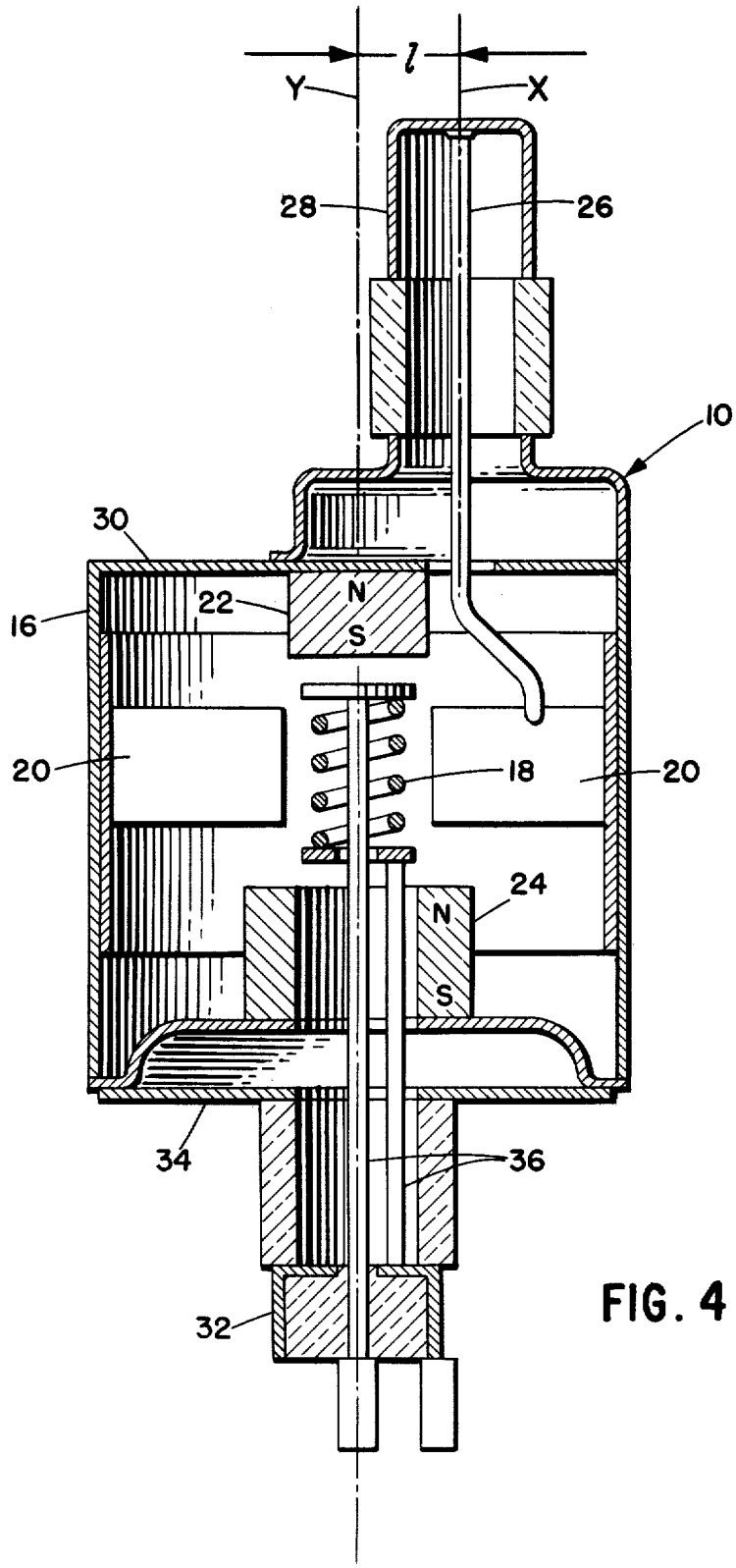
FIG. 4 is a vertical sectional view of a magnetron in accordance with this invention.

Referring now to the drawings, wherein like reference numerals designate identical corresponding parts of the embodiment, and more particularly to FIG. 1 thereof, FIG. 1 shows an internal magnet type magnetron of the invention comprising an evacuated body 10, cooling element 12 surrounding the evacuated body 10 and a shield box 14.

Evacuated body 10, as shown in FIG. 4 in detail, comprises a copper cylindrical anode 16 positioned along an anode axis, and a cathod 18 disposed coaxially with anode axis Y and positioned within anode 16. A plurality of radial vanes 20 are fitted on the inner wall of the anode and extend inwardly. An interaction space is formed between cathode 18 and vanes 20. A pair of internal magnets 22 and 24 are installed within anode 16 and are positioned axially along anode axis Y. An antenna lead 26 extends from one of vanes 20 to an antenna terminal 28. Antenna terminal 28 is positioned along an antenna axis X which is offset from anode axis Y by a distance 1. This offset is necessary in an internal magnet type magnetron since antenna lead 26 is prevented from extending axially along anode axis Y due to the coaxial positioning of magnet 22.

The top portion of anode 16 is sealed hermetically with a top plate 30 to which antenna terminal 28 is mounted. The bottom portion of the anode 16 is provided a bottom plate 34 to which a stem terminal 32 is mounted. Stem terminal 32 extends outwardly from bottom plate 34 along anode axis Y and supports cathode 18 with supporting rods 36. Cathode supporting rods 36 extend from stem terminal 32, through the center of the lower internal magnet 24 to support cathode 18 and are conductive to supply operating current to cathode 18.

As shown in FIGS. 1-3, around the outer periphery of cylindrical anode 16, a cooling element 12 (i.e., heat sink or heat radiator) is secured. As shown in FIG. 5, cooling element 12 comprises a plurality of radially oriented fins 40 formed by the steps of corrugating a metal plate of aluminum or copper and shaping the corrugated plate into a cylinder. Each corrugated portion is a respective cooling fin 40. The length L of successive fins 40 gradually varies from a minimum length $L_1$ at the shortest fin 42 to a maximum length $L_2$ at the longest fin 44 and substantially symmetrically disposed about a symmetrical plane A—A' which pass throuh antenna axis X, shortest fin 42 and longest fin 44. Consequently, the cooling element is formed to have a circular outermost periphery wherin each point on the periphery B lies at a substantially uniform radial distance from the antenna axis X. The circular innermost periphery of the cooling means surrounds anode 16 and the center of this inmost periphery coincides with the anode axis Y.

The corrugated element 12 can be made by a single aluminum plate. Also two symmetric half circular members can be joined together at the A—A' line (see FIG. 5). As shown in FIG. 6, such a half member 46 can be formed easily of a corrugated plate. Another modified cooling element of the invention can comprise a plurality of propeller or spoke-like fins formed by punching an aluminum plate and piled one upon another. Each fin of the plate can be twisted or folded for forming the coolant paths in a general direction substantially parallel to the anode axis. it should be noted that the longer fin can obtain more effective cooling than the shorter fin. Therefore the width W (see FIG. 5) between shorter fins can be made smaller than the distance between longer fins to balance the cooling effect of the shorter and longer fins.

As shown in FIGS. 1-3, a coolant guiding structure 48 which is made of thick paper or thin aluminum plate or thin steel plate surrounds the outermost periphery of cooling element 12 and is fastened thereto with a strap 62. Coolant guiding structure 48 guides coolant as it flows through and around shield box 14 and continues its flow through cooling element 12, as shown by the arrows of FIG. 1.

As shown in FIGS. 1-2, a mounting bracket 50 is attached to the top portion of the anode 16 for mounting the magnetron directly to a microwave oven or to a microwave oven waveguide. On both ends of mounting bracket 50, a plurality of bolts 52, symmetrical to antenna axis X, are provided for mounting the magnetron to the oven. As shown in FIG. 1, a filter 54 comprising a choke coil 56 and a capacitor 58 is connected to stem terminal 32. The shield box 14 having a plurality of holes 60 encloses the stem terminal 32 and filter 54 for shielding undesired radiation from the stem terminal 32 at the bottom portion of the anode 16. Shield box 14 is disposed along line A—A' in the direction of the longest fin 44. As will be discussed, this positioning of shield box 14 permits balanced air flow if the width W remains the same for all fins.

As shown in FIG. 2, the configuration of cooling element 12 allowing the antenna axis to be coaxial with the longitudinal center axis of the magnetron's overall shape, permits the mounting bolts 52 to be situated equidistant from antenna axis X. This structure, therefore, overcomes the disadvantages of the prior art since it can be easily mounted to most microwave ovens; that is, it is interchangeable with all conventional longitudinal type cooling magnetrons. The configuration of cooling element 12 overcomes the mounting space limitations and input plug inaccessibility experienced in the prior art when mounting conventional internal magnet type magnetrons within standard microwave ovens. By eliminating eccentricity, the magnetron of the instant invention can be freely rotated about its antenna axis for aligning the magnetron mounting bracket with the conventional mounting holes in the oven.

As discussed, the cooling element 12 comprises a plurality of fins 40 which extend radially outwardly from the anode axis Y as shown by line D in FIG. 5. Since all the fin portions C contracting the anode wall are substantially normal to radial line D, cooling element 12 securely contacts the anode 16. Rather than reducing the width W of the shorter fins with respect to the longer fins as previously discussed, the same width W can be used for all fins provided shield box 14 can be disposed along line A—A' in the direction of the longest fin 44. If the shield box 14 is not so positioned, too much air flow will pass through the longer fins rather than shorter fins and, as a result, the entire anode is not cooled uniformly. However, by positioning shield box 14 at the bottom portion of anode 16 and disposing it along the A—A' plane in the direction of the longest fin 44, more flow resistance is established at the longer fins than at the shorter fins. Consequently, the amount of coolant flowing through the longer fins decreases while the amount of coolant flowing through shorter fins increases. Adjusting the placement of shield box 14 along plane A—A' produces a balance of coolant flowing about the anode. In other words, the amount of coolant flowing in a direction substantially parallel to the anode axis and passing through the fins is balanced about a plane E—E' (see FIG. 5) perpendicular to the A—A' plane and passing through anode axis Y; consequently, the anode is uniformly cooled.

We claim

1. An internal type magnetron comprising:

an anode having an anode axis;

a cathode disposed within said anode;

an antenna terminal disposed along an antenna axis which is offset from and substantially parallel to said anode axis; and a cooling means surrounding said anode for cooling said anode, said cooling means having an outermost periphery, each point on the periphery lying at a substantially uniform radial distance from said antenna axis.

2. The magnetron of claim 1 wherein said cooling means comprises a plurality of fins which receive a coolant.

3. The magnetron of claim 2 wherein said fins are formed of at least one corrugated metal plate.

4. The magnetron of claim 2 wherein said anode comprises a top and bottom portion, and wherein the length of successive fins gradually varies from a minimum length to a maximum length and then back to the minimum length, the longest and shortest fins being substantially diametrically opposed and with the plurality of fins being substantially symmetrically disposed about a first plane which passes through the antenna axis and the shortest and longest fins, said magnetron further comprising a stem terminal disposed on an outer side of said bottom portion, a second plane perpendicular to said first plane and passing through the anode axis, and a shield means for enclosing said stem terminal, positioned at said bottom portion and displaced from a coaxial position with said anode axis along the first plane in the direction of the longest fin, whereby the amount of coolant flowing in a general direction parallel to said anode axis and passing through said fins is balanced about said second plane.

5. The magnetron of claims 2 or 4 wherein said magnetron further comprises coolant guiding means surrounding said cooling means for confining the flow of said coolant.

* * * * *